US005936171A

United States Patent [19]

Zhu et al.

[11] Patent Number: 5,936,171

[45] Date of Patent: Aug. 10, 1999

[54] FLYING BLOCK ASSEMBLY FOR SPEED REGULATION OF MUSIC BOX

[76] Inventors: Yunde Zhu, Room 52-406 Longwanxineun, Haishu District; Wei Wang, Room 363-4-507 Weinhualu, Haishu District, both of Ningbo City, Zhejiang 315000, China

[21] Appl. No.: 08/905,115

[22] Filed: Aug. 1, 1997

[30] Foreign Application Priority Data

Jan. 31, 1997 [CN] China ..... 97101539

[51] Int. Cl.[6] ..... G10F 1/06

[52] U.S. Cl. ..... 84/94.1

[58] Field of Search ..... 84/94.1, 94.2, 84/95.1, 95.2

[56] References Cited

U.S. PATENT DOCUMENTS

| | | | |
|---|---|---|---|
| 4,458,573 | 7/1984 | Isaka . | |
| 4,464,969 | 8/1984 | Isaka et al. | 84/95.1 |
| 4,570,524 | 2/1986 | Isaka . | |
| 4,890,528 | 1/1990 | Kamijima | 84/95.2 |
| 5,179,236 | 1/1993 | Shimotori et al. | 84/95.1 |
| 5,543,577 | 8/1996 | Zhu . | |

FOREIGN PATENT DOCUMENTS

| | | |
|---|---|---|
| 93235669 | 8/1994 | China . |
| 2286711 | 2/1997 | United Kingdom . |

*Primary Examiner*—Jeffrey W. Donels
*Attorney, Agent, or Firm*—Pillsbury Madison & Sutro LLP

[57] ABSTRACT

A flying block assembly for speed regulation of music box comprises a pair of flying blocks (1), a pair of link arms (2) and a central cylinder (4) which fixes the flying block (1) onto a speed regulating shaft (5), wherein an inertia frame (3) conventionally integrated with the speed regulating shaft (5) is changed to be integrated with the flying block assembly, and can move in axial direction of the speed regulating shaft. As the inertia frame (3) and the flying block assembly combine a connection rather than a separate body, the unthreaded poriton of the speed regulating shaft which is occupied usually by the inertia frame will be left for the flying block assembly moving upward or downward, so that it will cause the flying block for speed regulation to obtain much more adjusting range of axial diection.

13 Claims, 3 Drawing Sheets

FLYING BLOCK ASSEMBLY FOR SPEED REGULATION OF MUSIC BOX

BACKGROUND OF THE INVENTION

The present invention relates to speed regulation of a music box, and more particularly, to a flying block assembly for speed regulation which provides for easy adjustment by integrally supporting an inertia frame on a flying block assembly.

In the prior art, the speed regulating flying block of a music box is movably mounted on a speed regulating shaft on an unthreaded portion of the shaft. By applying hand pressure, the relative position of the flying block assembly to a damping friction disk, i.e., the distance between each of them, can be changed, so that the speed of playing music by the music box will be varied. Since the damping friction disk has a tapered surface opening downwardly and is located above the speed regulating flying block assembly, when the distance between the flying block and the damping friction disk is decreased frictional contact with arise more quickly between the flying blocks of the fling block assembly and the damping friction disk by the action of centrifugal force. Resistance to the energy release of a spiral power spring of the music box will be caused in this way, and the spring will meet such resistance more quickly. The time to play back a tune will thereby be extended and slower playback will result. On the contrary, when the speed regulating flying block assembly is adjusted to be relatively further from the damping friction disk, the frequency of frictional contact between the flying blocks and the inner tapered surfaced of the damping friction disk will be relatively less. The time for playing a tune from the beginning to the end will thereby be shortened, so the playback speed of a tune will be faster.

In the prior art of Chinese patent CN 21747671 Y (see FIGS. 5 and 6), an inertia frame fitted on the speed regulating shaft is not movable, which restricts the moving range of the speed regulating flying block in the axial direction of the speed regulating shaft. The speed regulating shaft of the music box in this conventional arrangement includes an upper section and a lower section, and is threaded on the lower section end and unthreaded on the upper section. A significant portion of the unthreaded portion is occupied by the inertia frame, and since the unthreaded portion has a limited length in the axial direction, an insufficient range of adjusting movement is available for the speed regulating flying block in the axial direction.

SUMMARY OF THE INVENTION

This invention has been made in view of the existing problems described in the prior art, and an object of the invention is to provide a flying block assembly for speed regulation in which the speed regulating flying block can be moved on the unthreaded portion of a speed regulating flying shaft for a greater range of speed adjustment.

In accordance with the invention, a flying block assembly is provided for adjustable speed regulation of a music box that includes a speed regulating shaft defining an axis. The flying bock assembly includes a central cylinder formed to receive the speed regulating shaft in friction fit permitting selective adjusting movement of the central cylinder along the axis. A plurality of flying blocks are provded, with each of the flying blocks being disposed about the central cylinder and connected to the central cylinder by a link arm. Each of the flying blocks also has a friction surface. An inertia frame is supported about the central cylinder to move integrally with the central cylinder along the axis.

The inertia frame may advantageously include a pair of opposed stop members for being engaged by a stop element to stop rotation of the flying block assembly. Each of the flying blocks may have a predetermined radial extent, and each of the stop members may include a portion extending radially outward beyond the radial extent of the flying blocks.

The flying block assembly of the present invention thus provides for easy and accurate adjustment of the speed regulation of a music box. The inertia frame, the central cylinder and the flying blocks can be moved together along the axis of the speed regulating shaft for speed adjustment.

The present invention will now be described in detail with reference to the accompanying drawings.

DETAILED DESCRIPTION OF THE PREFERRED EMBODIMENT

Figure 1:
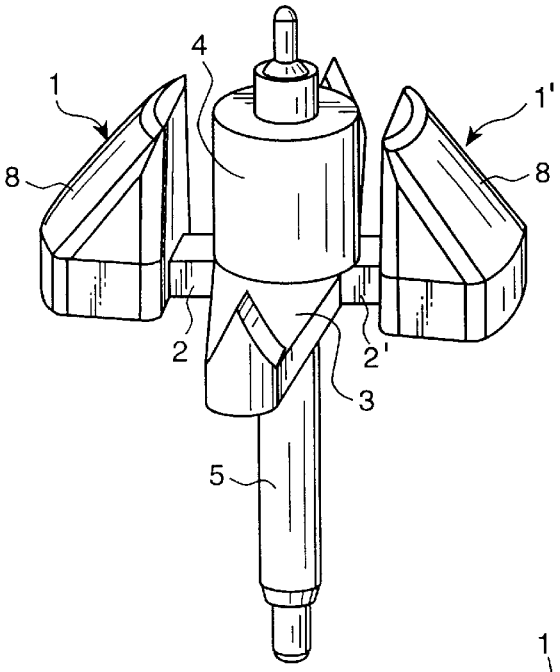
FIG. 1 is a perspective view of a flying block assembly in accordance with the present invention.

A preferred embodiment of the present invention is shown in FIG. 1, which depicts a flying block assembly 7 for a music box including a pair of speed regulating flying blocks 1,1' which are joined at lower portions thereof to a pair of link arms 2,2', which are in turn connected to a lower portion of a central cylinder 4 having a central hole 6. By means of the central hole 6, the central cylinder 4 is adjustably mounted on a speed regulating shaft 5 in a movable friction fit. An inertia frame 3 is also connected to the central cylinder 4. A friction surface 8 is formed on each of the flying blocks 1,1' for engaging a friction disk (not shown).

When it is desired to adjust the position of the flying block assembly 7 to regulate the speed of the music box's playback, the flying block assembly 7 can be easily moved up or down along the axis of the speed regulating shaft 7. To increase the speed of the music box, either the top surface of the central cylinder 4 or the top surface of the inertia frame 3 can be engaged by hand or by a tool to move the entire flying block assembly 7 downward. In this manner, the flying block assembly 7 will be moved further away from the damping friction disk (not shown) to reduce the frequency at which the friction surface 8 on each flying block 1,1' will engage the friction disk to slow the rotation of the flying block assembly 7. To decrease the speed of the music box, a user can either apply pressure to the bottom surface of the inertia frame 3 or the bottom surface of the link arms 2,2' to move the flying block assembly 7 upward along the axis of the speed regulating shaft 5, which brings the flying block assembly 7 closer to the friction disk. In this manner the distance between the flying block assembly 7 and the friction disk will be decreased, and the friction surfaces will engage the friction disk to a greater extent, thereby slowing the speed of the music box.

Figure 3:
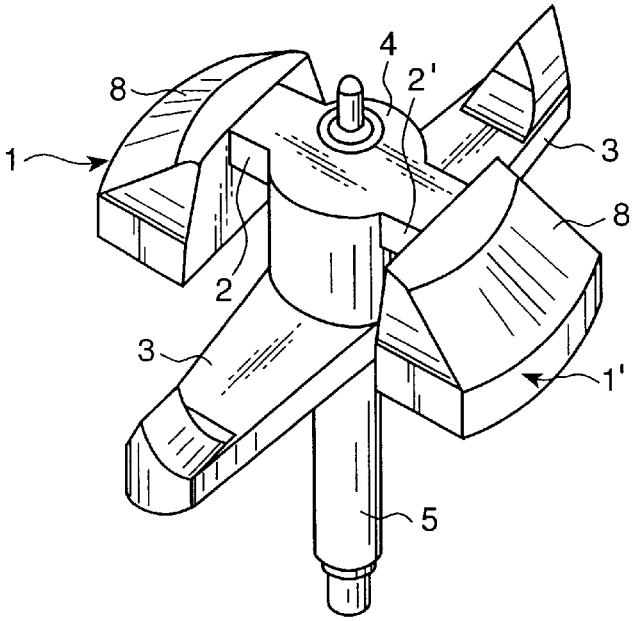
FIG. 3 is a perspective view of another embodiment of a flying block assembly in accordance with the present invention.

Another embodiment of the present invention is shown in FIG. 3, in which the flying blocks 1,1' are joined at an upper portion thereof by link arms 2,2' to an upper portion of the central cylinder 4. The inertia frame 3 is joined to a lower portion of the central cylinder 4. The speed regulating shaft 5 is received in moveably adjustable friction fit in the central hole 6 of the central cylinder 4 so that the position of the flying block assembly 7 can be adjusted along the axis of the shaft 5.

Figure 2:
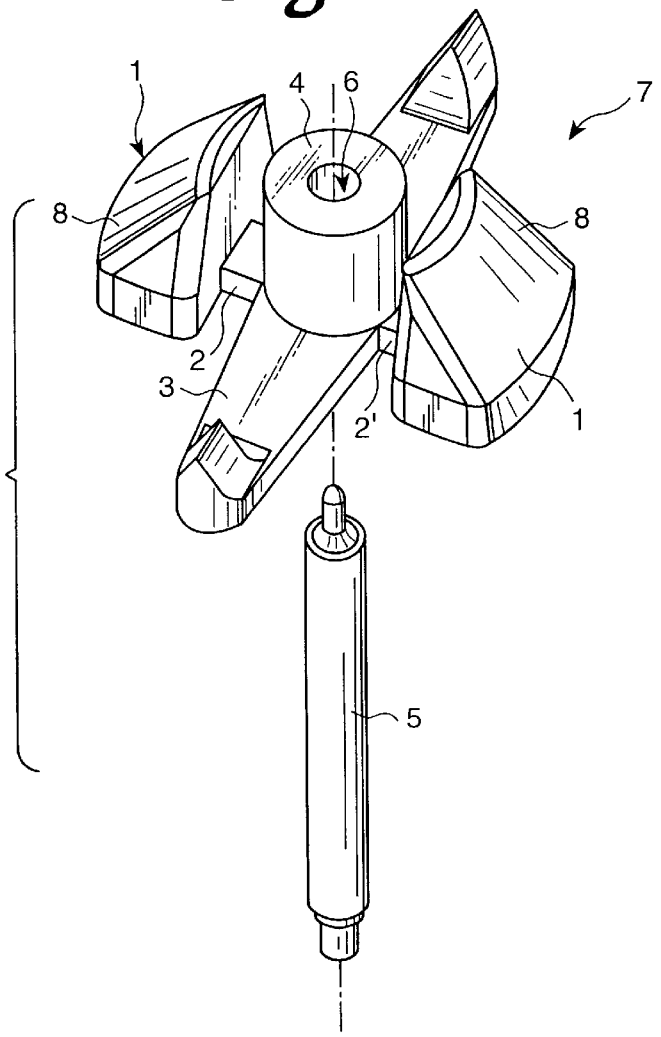
FIG. 2 is an exploded perspective view of the flying block assembly of FIG. 1.

As in the embodiment of FIGS. 1 and 2, the speed of the music box can be varied by moving the flying block assembly 7 by hand or with a tool. Moving the flying block assembly 7 downward by pressing on the top surface of the central cylinder 4 or the top surfaces of the link arms 2,2' will increase the distance of the friction surfaces 8 from the friction disk, and thereby speed up the music box. Moving the flying block assembly upward along the axis of the shaft 5 will bring the friction surfaces 8 closer to the friction disk, and as a result decrease the speed of the music box.

Figure 4:
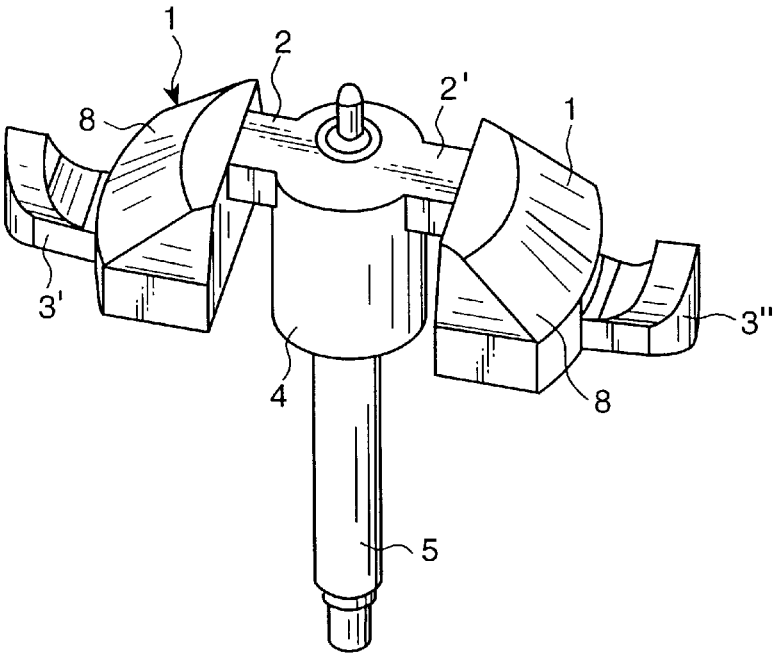
FIG. 4 is a perspective view of another embodiment of a flying block assembly in accordance with the present invention.

In FIG. 4, an additional embodiment of the present invention is illustrated. The inertia frame includes two projecting portions 3',3", each of which extends radially outward from one of the flying blocks 1,1'. The projecting portions 3',3" and the flying blocks 1,1' are generally aligned about the central cylinder 4. The link arms 2,2' are joined to an upper portion of the central cylinder 4.

The inertia frame 3, as described above, not only acts as an inertial member to steady the playback speed of the music box, but also as a stop member for stopping the music box. To stop the music box, a braking rod (not shown) is inserted from top to bottom, into the inertia frame 3 where it is in a rotary range of maximum diameter. The inertia frame 3 will then be retained by the braking rod to stop its rotation, so that the music box does not work.

The inertia frame 4 can serve to function as a stop member in each of the embodiments illustrated in FIGS. 1–4. Since the inertia frame 4 extends radially outward beyond the radial extent of the flying blocks 1,1' as can be clearly seen, a braking rod or stop element can contact the inertia frame 4 without engaging the flying blocks 1,1' if desired, to thereby stop the rotation of the flying block assembly 7.

Figure 5:
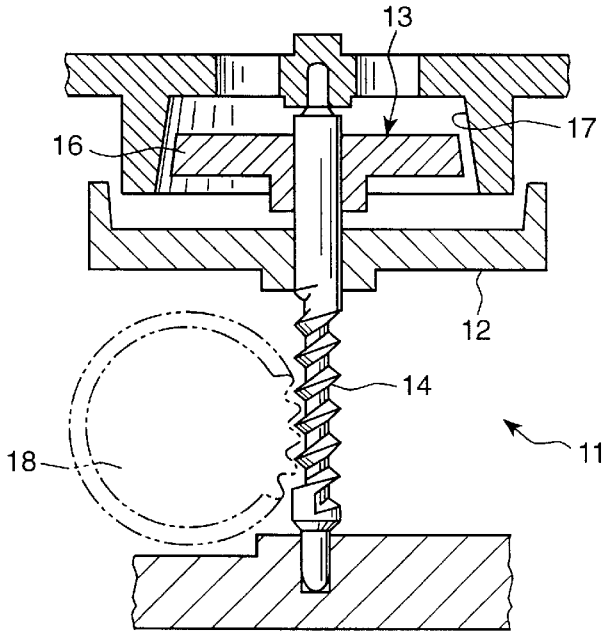
Fig. 5 (PRIOR ART)
FIG. 5 is a cross-sectional view showing a speed regulating assembly of prior art.
Figure 6:
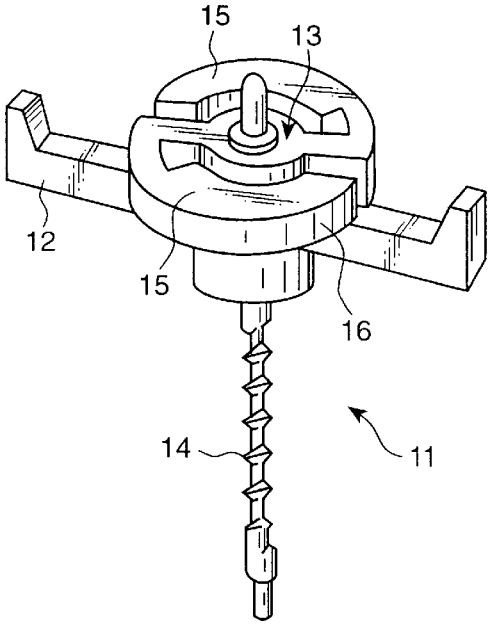
Fig. 6 (PRIOR ART)
FIG. 6 is a perspective view showing a speed regulating assembly of prior art.

A previous flying block arrangement 11 for regulating the speed of a music box is shown in FIGS. 5 and 6. An inertia frame 12 and a separate flying block clement 13 are fitted onto an unthreaded portion of a speed regulating shaft 14. The flying block element 13 includes flying block arms 15 and friction surfaces 16. A friction disk 17 is positioned above the flying block element 13. The speed regulating shaft 14 is driven by a spur gear 18.

As is well known by those of skill in the art, rotation of the speed regulating shaft 14 will in turn cause rotation of the flying block element 13, and the resulting centrifugal force will cause the flying block arms 15 to be displaced radially outward. Once the speed of the flying block element 13 and the resulting outward displacement reach a certain level, the friction surfaces 16 will contact the friction disk 17, thereby acting to brake the speed of the speed regulating shaft 14 and the music box. The regulating effect of the flying block element 13 can be adjusted by moving it axially along the unthreaded portion of the shaft 14 to bring the friction surfaces 16 either closer to or further away from the friction disk 17.

Prior art devices of this type, however, provide only a limited range of possible adjustment, since the flying block element 13 is formed separately from the inertia frame 12. That is, the inertia frame 12 occupies a certain extent of the unthreaded portion of the shaft 14, and this portion of the shaft 12 is therefore not available for positioning of the flying block element 13 thereon. In this way, the range of adjustment of the prior art arrangement 11 was restricted.

The advantages and results of the present invention are that the speed adjustment is convenient, since the speed regulating flying block assembly can be touched by a tool or by hand in two directions from the top and bottom, and the range of speed adjustment is enlarged, since the range of the movement on the unthreaded portion of the speed regulating shaft is extended so as to obtain a wide speed range for regulating the playing speed of the music box.

We claim:

1. A flying block assembly for adjustable speed regulation of a music box having a speed regulating shaft defining an axis, comprising:

a central cylinder formed to receive the speed regulating shaft in friction fit permitting selective adjusting movement of said central cylinder along the axis;

a plurality of flying blocks, each of said flying blocks being disposed about said central cylinder and connected to said central cylinder by a link arm, each of said flying blocks having a friction surface; and an inertia frame supported about said central cylinder to move integrally with said central cylinder along the axis, whereby speed regulation of the music box can be selectively adjusted by integrally moving said central cylinder, said flying blocks and said inertia frame along the axis.

2. The flying block assembly of claim 1, wherein said plurality of flying blocks comprises a pair of flying blocks, said flying blocks being disposed in diametrically opposed relation to each other about said central cylinder.

3. The flying block assembly of claim 1, wherein said friction surface is tapered.

4. The flying block assembly of claim 1, wherein said central cylinder defines a central bore for receiving the speed regulating shaft in axially adjustable friction fit.

5. The flying block assembly of claim 1, wherein said inertia frame is joined to said central cylinder, said inertia frame extending radially outward from said central cylinder in diametrically opposed directions.

6. The flying block assembly of claim 1, wherein said inertia frame includes a pair of stop members for being engaged by a stop element to stop rotation of the flying assembly.

7. The flying block assembly of claim 6, wherein said stop members are disposed in diametrically opposed relation about said central cylinder.

8. The flying block assembly of claim 6, wherein each of said flying blocks has a predetermined radial extent, and each of said stop members includes a portion extending radially outward beyond said radial extent of each of said flying blocks.

9. The flying block assembly of claim 1, wherein each of said link arms is joined to said central cylinder at a vertically lower portion of said central cylinder.

10. The flying block assembly of claim 1, wherein each of said link arms is joined to said central cylinder at a vertically upper portion of said central cylinder.

11. The flying block assembly of claim 1, wherein said inertia frame is joined to said central cylinder at a vertically lower portion of said central cylinder.

12. The flying block assembly of claim 1, wherein said inertia frame includes two projecting portions, and each of said projecting portions extends radially outward from one of said flying blocks.

13. A flying block assembly for adjustable speed regulation of a music box having a speed regulating shaft defining an axis, comprising:

a central cylinder formed to receive the speed regulating shaft in friction fit permitting selective adjusting movement of said central cylinder along the axis;

a pair of flying blocks, each of said flying blocks being disposed about said central cylinder in opposed relation to each other and connected to said central cylinder by a link arm, each of said flying blocks having a tapered friction surface; and an inertia frame supported about said central cylinder to move integrally with said central cylinder along the axis, said inertia frame including a pair of stop members disposed in opposed relation;

each of said flying blocks having a predetermined radial extent, and each of said stop members including a portion extending radially outward beyond said radial extent of said flying blocks.

* * * * *

UNITED STATES PATENT AND TRADEMARK OFFICE

CERTIFICATE OF CORRECTION

| | |
|---|---|
| PATENT NO. | :5,936,171 |
| DATED | :August 10, 1999 |
| INVENTOR(s) | :ZHU et al. |

It is certified that error appears in the above-identified patent and that said Letters Patent is hereby corrected as shown below:

ON THE FACE OF THE PATENT

Please add:

--[73] Assignee: Ningbo Yunsheng (Group) Co., Ltd., Ningbo city, China--

Signed and Sealed this

First Day of August, 2000

*Attest:*

Q. TODD DICKINSON

*Attesting Officer*

*Director of Patents and Trademarks*